US007673358B2

(12) United States Patent
Dietz et al.

(10) Patent No.: US 7,673,358 B2
(45) Date of Patent: Mar. 9, 2010

(54) METHOD OF CONTROLLING THE REVOLUTIONS OF THE DRUM OF A PROGRAM CONTROLLED LAUNDRY MACHINE

(75) Inventors: Walter Dietz, Guetersloh (DE); Diethard Krause, Guetersloh (DE); Daniel Schneider, Verl (DE)

(73) Assignee: Miele & Cie KG., Guetersloh (DE)

( * ) Notice: Subject to any disclaimer, the term of this patent is extended or adjusted under 35 U.S.C. 154(b) by 1342 days.

(21) Appl. No.: 10/672,783

(22) Filed: Sep. 26, 2003

(65) Prior Publication Data

US 2005/0066999 A1 Mar. 31, 2005

(51) Int. Cl.
*D06F 35/00* (2006.01)

(52) U.S. Cl. ..... 8/158; 68/12.04; 68/12.06

(58) Field of Classification Search ..... 8/158; 68/12.04, 12.06
See application file for complete search history.

(56) References Cited

U.S. PATENT DOCUMENTS 5,335,524 A * 8/1994 Sakane ..... 68/12.04
5,560,061 A 10/1996 Wentzlaff et al.
5,704,136 A 1/1998 Cho et al.
5,765,402 A * 6/1998 Ikeda et al. ..... 68/12.06
6,415,469 B1 * 7/2002 Fernandez et al. ..... 8/158
6,581,230 B2 * 6/2003 Weinmann ..... 8/159

FOREIGN PATENT DOCUMENTS

| | | |
|---|---|---|
| DE | 3436786 | 4/1986 |
| DE | 3741792 | 6/1989 |
| DE | 3933355 | 5/1990 |
| DE | 4438760 | 5/1996 |
| DE | 10005991 | 8/2000 |
| DE | 10014718 | 10/2001 |
| GB | 2253215 | 9/1992 |
| GB | 2322141 | 8/1998 |
| GB | 2322141 A * | 8/1998 |
| JP | 11057297 | 3/1999 |

* cited by examiner

*Primary Examiner*—Alexander Markoff
(74) *Attorney, Agent, or Firm*—Darby & Darby

(57) ABSTRACT

A laundry treatment method consisting of controlling the rotational speed a program-controlled laundry machine drum between lower and upper limits as a function of at least one predetermined parameter of the laundry within the drum.

9 Claims, 3 Drawing Sheets

Figure 1:
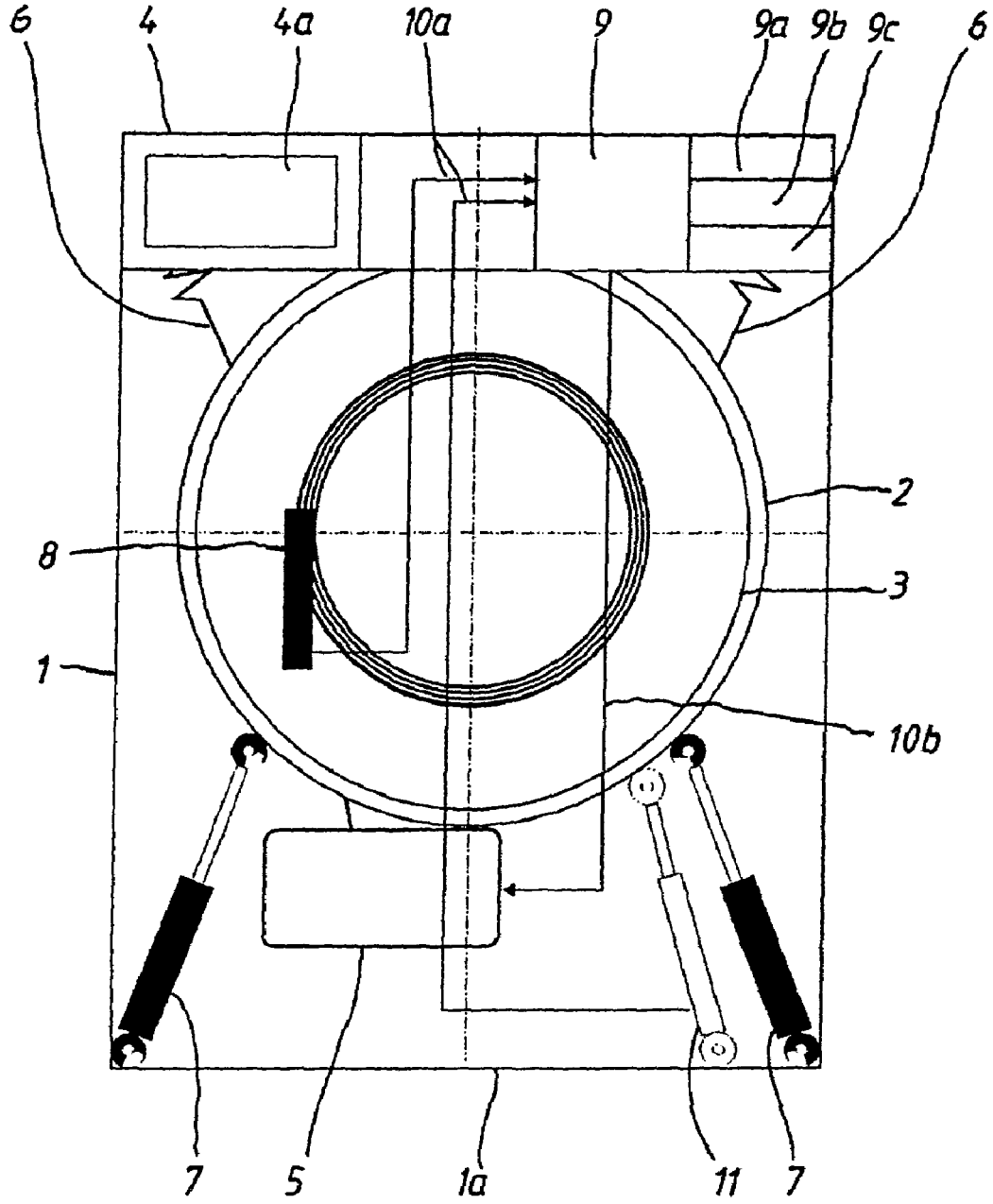

METHOD OF CONTROLLING THE REVOLUTIONS OF THE DRUM OF A PROGRAM CONTROLLED LAUNDRY MACHINE

BACKGROUND OF THE INVENTION

1. Field of the Invention

The invention relates to a method of controlling the rotational speed of the drum of program controlled laundry treatment machines such as, for instance, washing machines, washer-dryers and dryers, of the kind provided with a drum rotatable about an at least approximately horizontal axis, a drive motor for the drum, a measuring device for defining the load parameters as a function of the laundry put into the drum, and with a control device for setting the drive motor for different revolutions per minute during the various cycles of a washing or drying program, such that during part of a washing or drying program individual rotating cycles are carried out with intermittent idle periods, the drum being driven during a rotational cycle at different rotational speeds ranging between upper and lower values. Unless otherwise indicated hereinafter, machines of the kind under consideration will be referred to as laundry machines.

2. The State of the Art

When textiles are being washed, the mechanical action affecting the laundry is one of the significant factors in terms the result of the washing operation. To provide the most efficient washing action in a washing machine equipped with a horizontally or at least approximately horizontally suspended rotary drum, individual pieces of the laundry should be moved to about the 12-o'clock-position and then, upon release from the wall of the drum, drop down in consequence of gravity. This is brought about by the centrifugal force of the laundry being slightly less than the gravity of the earth. Since the centrifugal force is a function of the distance of a piece of laundry from the rotational axis of the drum, a rotational cycle implemented at a predetermined constant rotational speed is of advantage only in respect of those laundry pieces which have moved to a certain distance from the axis of the drum. The standard value of this distance is assumed to be the same as the radius of the drum. Laundry closer to the axis of the drum drops substantially sooner, i.e. it separates at the 9- or 10-o'clock-position, and instead of a dropping movement, it goes through a rolling movement.

From DE 34 36 786 A1 it is known during washing to drive the drum at a speed dependent upon the quantity of laundry such that with increasing quantities of laundry, higher rotational speeds are applied. Thus, those items of the laundry which are at a large distance from the rotational axis are subjected to strong gravitational forces and they form a ring engaging the wall of the drum. This prevents the laundry from dropping freely.

From DE 39 33 355 it is known during a laundry operation to provide cycles of alternating rotational directions with intermittent idle periods, the drum being initially rotated at an upper speed of 55 $min^{-1}$ followed by a lower speed of 40 $min^{-1}$. The purpose of the higher speed is to subject the laundry to satisfactory mechanical action, and the lower speed is to ensure sufficient soaking of the laundry.

DE 100 05 991 A1 discloses a washing machine provided with a measuring sensor, such as a spring scale, for defining a load step corresponding to the weight of the laundry deposited into the drum.

A washing machine is known from DE 44 38 760 A1 in which, based on the oscillations of the signal of rotations during a reverse cycle, a measuring device defines a load step depending on the kind and quantity of the laundry placed into the drum.

In the washing machine W 487 WPS manufactured and sold by the assignee, the drum, during the "boiling-/colored laundry" cycle of a wash program, is operated in accordance with the rotational cycle known from DE 39 33 355 A1, and it is provided with the weight measuring feature in accordance with DE 100 05 991 A1. In the washing machine W 453 WPS manufactured and sold by the assignee, the drum, during the "boiling-/colored laundry" cycle of a wash program, is also rotated in accordance with the cycle known from DE 39 33 355 A1, but it is provided with the load step recognition known from DE 44 38 760 A1.

DE 100 14 718 A1 discloses a laundry dryer provided with a feature for detecting the pattern of laundry movement as a function of the laundry placed in the dryer. The dryer is equipped with controls for energizing the drive motor of the drum in response to the movement pattern of the laundry in the drum such that a desired pattern of laundry movement in the drum may be set by way of the rotational speed of the drum. Its purpose is during the drying process to move the laundry in the drum through the heated air in a predetermined trajectory. While suitable for laundry consisting of large sheets, as used in hospitals, for instance, controlling the rotational speed of the drive motor of the drum as a function of the pattern of laundry movement is unsuitable for household laundry.

OBJECT OF THE INVENTION

It is an object of the invention to provide a method of controlling the rotational speed of the drum of a program-controlled laundry machine of the kind referred to above, which provides for subjecting the laundry to improved mechanical action during a washing process or to uniform air permeation during a drying process.

SUMMARY OF THE INVENTION

This and other objects of the invention are accomplished by a method of controlling rotational speed of the drum of program-controlled laundry treatment machines of the kind provided with a drum rotatable about an at least approximately horizontal axis, a drive motor for the drum, a measuring device for defining load parameters depending upon the laundry deposited into the drum, and with a control device for setting different rotational speeds of the drive motor during the various cycles of a laundry treatment program so that during part of such a program individual rotation cycles will be carried out with intermittent idle periods, the drum being driven during a rotation cycle at different speeds ranging between upper and lower limits set by the control in response to the defined load parameter.

Other objects and advantages will in part be obvious and will, in part, appear hereinafter.

DESCRIPTION OF THE SEVERAL DRAWINGS

Figure 2:
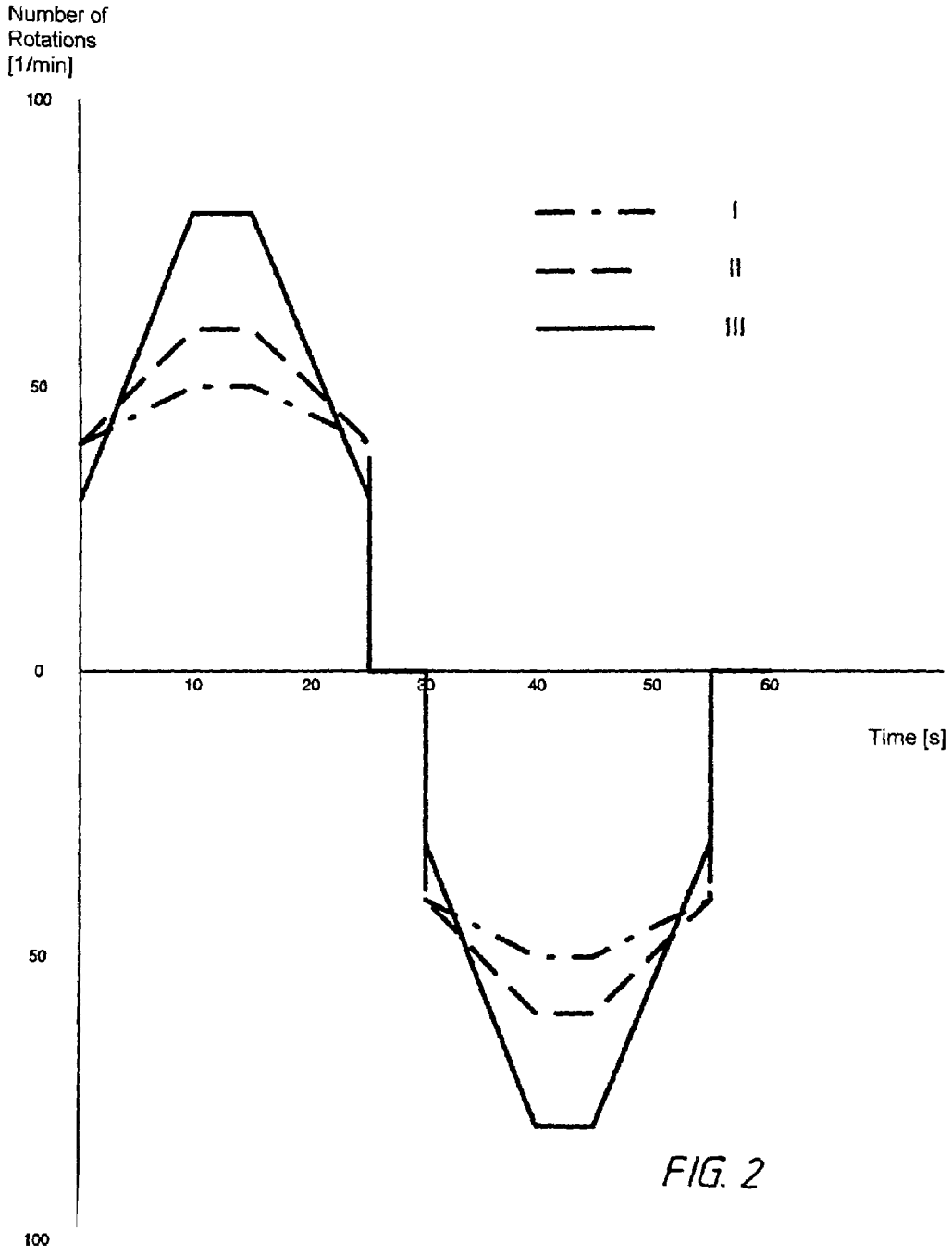
Figure 3:
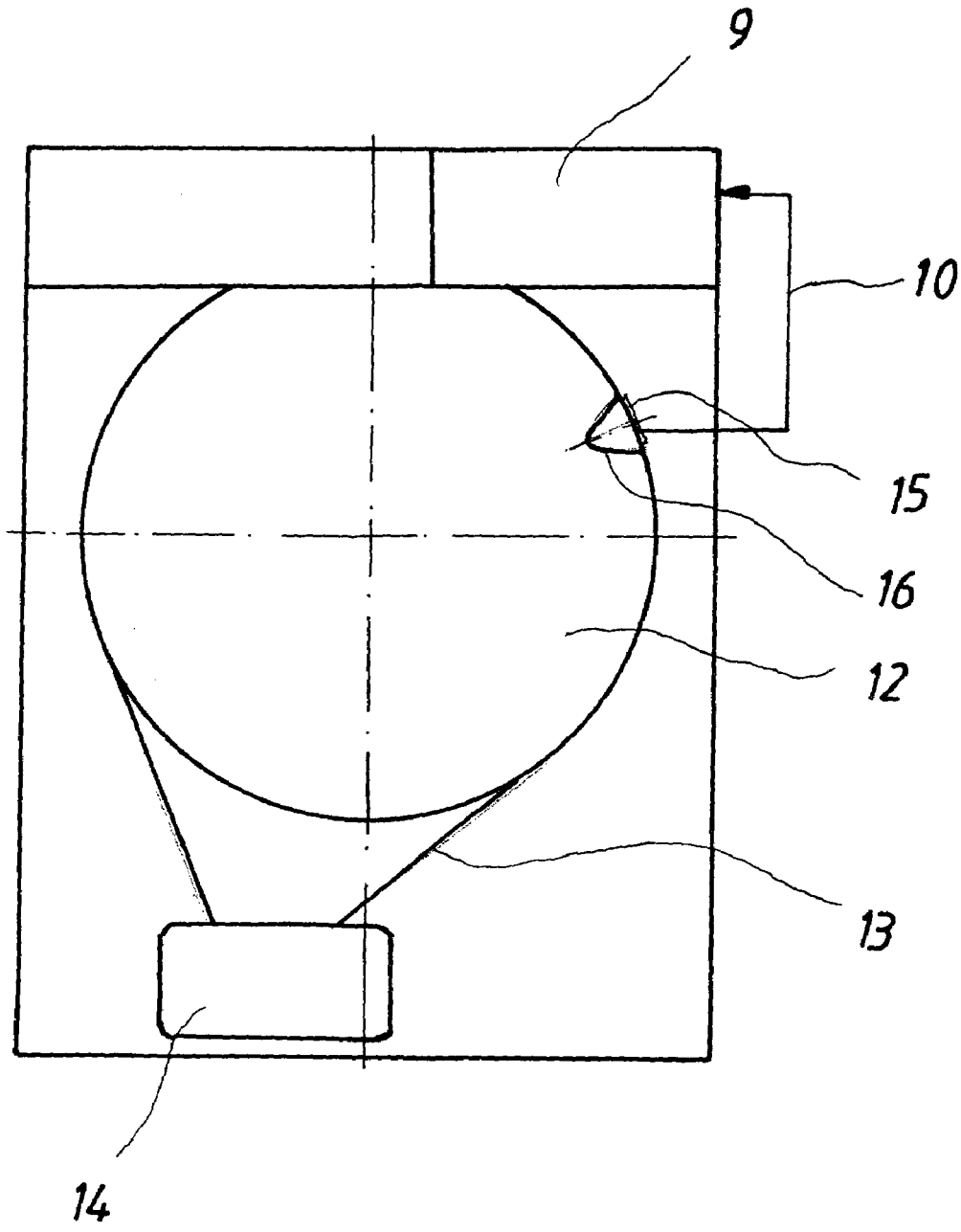

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIG. 1 schematically depicts the structure of a washing machine;

FIG. 2 depicts a rotation-time-diagram for two rotational cycles in reverse operation at different load steps; and FIG. 3 schematically depicts the structure of a dryer.

DETAILED DESCRIPTION OF THE PREFERRED EMBODIMENTS

The laundry machine shown in FIG. 1 is a washing machine provided with a suds basin 2 in which a drum 3 for receiving laundry is rotatably mounted. For washing, water and detergent are fed to the suds basin 2 by way of a drawer 4*a* of a detergent flushing compartment 4. While detergent is being dispensed, the drum 3 is alternatingly rotated in opposite directions by a drive motor 5. The suds basin 2 is suspended for oscillatory movements by springs 6, and, for attenuating the oscillations, it is supported at its lower section by shock absorbers 7 connected to the bottom of the housing 1*a*. While the machine is in operation, the suds basin 2 is closed by a door (not shown) mounted at the front wall of the housing. The door is kept in its locked condition by an electromagnetic latching device 8.

A microprocessor control 9 is provided for controlling the various washing programs. It is connected to a plurality of sensors and servo-elements (not shown). From time to time it issues time and condition dependent signals by way of control line 10*b* to different actuators such as, for instance, the motor 5, the latching device 8, valves (not shown), heating elements and pumps (not shown), and it also functions as a control unit for energizing the motor to run at different rotational speeds and in alternating directions. For instance, during at least part of a washing operation, the drum 3 is rotated in alternating directions with idle periods between individual rotating cycles. The applied pattern or profile of rotations will be described hereinafter. The microprocessor control 9 is provided with read-only memories (ROM) 9*a-c*.

One of the sensors of the washing machine constructed in accordance with the invention is a weight sensor 11 for determining the weight of the laundry within the drum 3. The sensor may, for instance, be a torsion balance or spring scale 11 mounted in a well-known manner parallel to a shock absorber 7 for measuring the height or level of the suds basin as a function of the weight of the laundry. Other sensors (not shown) such as expansion strips may also be used. The microprocessor control 9 determines, and reads into memory, a load step $B_s$ on the basis of the static portion of a displacement signal from the torsion balance 11 which corresponds to the weight of the laundry within the drum 3.

As an alternative to the weight sensor, the load step $B_s$ may be determined by a method known from DE 44 38 760 A1 on the basis of the kind and quantity of laundry, in accordance with which an evaluation circuit integrated in a microprocessor control defines the load step as a function of the oscillation pattern of the rotation signal during a rotational cycle in an initial part of the program, for instance, during a pre-wash program or during the main program.

After sensing the load step by the weight sensor or evaluation circuit the rotational cycles within a washing program are adjusted to the quantity of laundry in the drum 3. For this purpose, the microprocessor control 9, as the control device of the drive motor 5, sets, as a function of the stored load step value $B_s$, a lower value $n_{min}$ and upper value $n_{max}$ as upper and lower limits of the rotational speed of the drum 3 during the washing operation, as shown in the following table:

| Load Step $B_s$ | minimum rpm $n_{min}$ | maximum rpm $n_{max}$ |
|---|---|---|
| 1 kg | 40 $min^{-1}$ | 50 $min^{-1}$ |
| 2 kg | 40 $min^{-1}$ | 55 $min^{-1}$ |
| 3 kg | 35 $min^{-1}$ | 60 $min^{-1}$ |
| 4 kg | 30 $min^{-1}$ | 70 $min^{-1}$ |
| 5 kg | 30 $min^{-1}$ | 80 $min^{-1}$ |

The range of rotational speeds thus set as a function of the load step is executed as the substantially trapezoidal pattern or profile shown in FIG. 2. Alternatively, the profile of rotations may have an ascending and a descending slope, or it may assume the shape of a roof.

The structuring of the method as provided by the invention takes into consideration the fact that laundry is distributed in several layers at different radii relative to the circumference of the drum, the number of layers being dependent upon the size of the load. As a result of the load-related variation in the number of rotations during a cycle of rotations, each layer of laundry is optimally agitated. At very small loads slow rotations at a narrow range between lower and upper values of rotational speed is utilized to ensure that the laundry is released from the wall of the drum and that high washing mechanics or action are achieved nevertheless. Thus, the profile or pattern of the rotations resembles a relatively flat trapezoid (see the dash-dotted line I in FIG. 2). At medium loads the range of rotations may be increased up to 60 $min^{-1}$ since adherence of the laundry against the wall of the drum occurs only at values higher than 60 $min^{-1}$ (see the dashed line II trapezoid in FIG. 2). At large loads a wide band width or range of rotations is required since the laundry in the drum is stacked in several layers so that the centrifugal forces within these layers vary widely (see the solid line trapezoid III in FIG. 2). By initially increasing the number of rotations from 30 to 80 rpm, the laundry in the outer area is agitated strongly. By increasing the number of rotations, the laundry will be forced into engagement with the wall of the drum, and laundry disposed further inwardly, i.e. closer to the center of rotation, is lifted to the 12 o'clock position, and because of the engagement of the outer laundry with the wall of the drum, more drop-down space is available for the inwardly disposed laundry. A further increase in the number of rotations causes the effect of being displaced further towards the center of the drum. Thereafter, the laundry in the outer layer is again released from the wall of the drum by reducing the number of rotations.

The laundry machine shown in FIG. 3 is a dryer for executing the drying process in accordance with the invention and is provided with a rotatable horizontally journalled drum 12 for receiving laundry as well as with a blower for feeding drying air heated by a heating device (not shown) into the drum 12. The drum 12 is rotated in alternating directions by a drive motor 14 connected to the drum 12 by a drive belt 13. The dryer is additionally equipped with a device for detecting and evaluating residual wetness of the laundry as well as the quantity of the load.

A microprocessor control 9 is provided for controlling various drying programs for different loads. The microprocessor control 9 is connected to several sensors and operating elements by means of signal lines 10. The control 9 issues signals depending upon time and condition over control lines to various actuators and thus functions as a control for setting the drive motor 14 to run at different numbers of rotations. For instance, the drum 12 is rotated in alternating directions during part of a drying program, with idle periods interspersed between individual rotary cycles.

After sensing the weight of the load and/or any residual wetness, the number of rotations within individual segments of the drying program is adjusted to the quantity or residual wetness of laundry in the drum 14. For this purpose, the microprocessor control 9, as the control unit for setting the drive motor 14 in accordance with dryer-specific stored load quantities and residual wetness stages, sets lower limits $n_{min}$ and upper limits $n_{max}$ for the rotational speed of the drum.

The applied profiles of the number of rotations are substantially similar to those described supra in connection with the washing program.

One of the sensors of the laundry dryer in accordance with the invention is a sensor arrangement 15 for detecting residual laundry wetness by way of a striker rib 16 disposed within the drum 12. The residual wetness is detected in a known manner as a function of the conductivity of the laundry.

The described method is of special importance in connection with the washing and drying of cotton textiles in a boiling/colored laundry program, since large quantities of such laundry are usually deposited in the drum. It may be useful also to make use of the described rotary profiles in connection with rinsing cycles as they enhance the soaking of the laundry with rinsing water and thus lead to an improved rinsing action.

What is claimed is:

1. A method of controlling a laundry treatment machine having laundry disposed therein, the method comprising the steps of:

measuring a load parameter using a measuring device, the load parameter being a function of the laundry disposed in the laundry treatment machine;

setting an upper and a lower limit of a rotational speed of a drum of the laundry treatment machine as a function of the load parameter; and rotating the drum with a drive motor according to the set upper and lower limits.

2. The method of claim 1, wherein the setting is performed so as to set the lower and upper limits in proportion to the measured load parameter.

3. The method of claim 2, wherein the rotating is performed so as to rotate the drum at the start of a washing cycle of the laundry treatment machine at a rotational speed lower than respective rotational speeds later in the washing cycle.

4. The method of claim 3, further comprising setting the respective rotational speeds of the washing cycle so as to yield a rotational speed versus time profile of substantially trapezoidal configuration.

5. The method of claim 3, further comprising setting the respective rotational speeds of the washing cycle so as to yield a rotational speed versus time profile of substantially pointed configuration.

6. The method of claim 1, wherein the lower limit lies between 30 and 40 rpm.

7. The method of claim 1, wherein the upper limit lies between 50 and 80 rpm.

8. The method of claim 1, wherein the setting is performed using a control.

9. The method of claim 1, wherein the load parameter is a function of a weight of the laundry disposed in the laundry treatment machine.

* * * * *